US006868832B2

(12) United States Patent
Tamechika et al.

(10) Patent No.: US 6,868,832 B2
(45) Date of Patent: Mar. 22, 2005

(54) ELECTRONIC CONTROLLED FUEL INJECTION APPARATUS OF INTERNAL COMBUSTION ENGINE

(75) Inventors: Takao Tamechika, Saitama (JP); Naoya Toida, Saitama (JP); Yoshihisa Shinogi, Saitama (JP); Kazutomo Nishida, Saitama (JP); Kazumi Miyashita, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/876,633

(22) Filed: Jun. 28, 2004

(65) Prior Publication Data

US 2005/0005914 A1 Jan. 13, 2005

(30) Foreign Application Priority Data

Jul. 9, 2003 (JP) ..... 2003-194284
Jul. 9, 2003 (JP) ..... 2003-194285

(51) Int. Cl.[7] ..... F02M 51/00
(52) U.S. Cl. ..... 123/478; 123/406.23
(58) Field of Search ..... 123/478, 446, 123/495, 406.23, 406.54, 406.56

(56) References Cited

U.S. PATENT DOCUMENTS 5,161,496 A 11/1992 Matsushima et al. ..... 123/478
5,365,893 A * 11/1994 Wissmann et al. ..... 123/73 C
5,808,451 A * 9/1998 Endou et al. ..... 322/24
6,489,690 B1 12/2002 Hatsugai et al. ..... 123/2
6,557,509 B1 * 5/2003 Hall et al. ..... 123/179.16
6,659,069 B2 * 12/2003 Shiraishi et al. ..... 123/298
2001/0007249 A1 * 7/2001 Ishikawa et al. ..... 123/73 AF
2004/0078134 A1 * 4/2004 Yin et al. ..... 701/104

FOREIGN PATENT DOCUMENTS

JP 8-9393 3/1996
JP 2580367 B 11/1996
JP 2000-328957 11/2000
JP 2001-207941 8/2001

* cited by examiner

*Primary Examiner*—Hai Huynh
(74) *Attorney, Agent, or Firm*—Westerman, Hattori, Daniels & Adrian, LLP

(57) ABSTRACT

The invention intends to downsize a general-purpose engine generator and make operability thereof easy. A backup battery (233) is provided for the generator (22). The battery supplies electricity to an electronic controlled device such as a fuel pump for starting the engine. When the engine (1) carries out a rating operation, electricity is supplied from the generator (22). When the engine speed in a low speed range, only a pump (15) is driven. When the engine speed is exceeds the low speed range, the pump (15) is stopped, and an injectors, (10) and (27) are driven to be prevented from lapping over each other. When the engine speed reaches a high-speed range, the pump (15) is again driven. Electricity consumption at a time of starting is restricted by driving the electronic controlled devices at different timings until the engine (1) operation becomes self-sustaining.

7 Claims, 5 Drawing Sheets

ELECTRONIC CONTROLLED FUEL INJECTION APPARATUS OF INTERNAL COMBUSTION ENGINE

BACKGROUND OF THE INVENTION

1. Field of the Invention

The present invention relates to an electronic controlled fuel injection apparatus of an internal combustion engine, and more particular to an electronic controlled fuel injection apparatus of a relatively compact internal combustion engine which can be started on the basis of a manual operation without using a starter motor.

2. Description of the Related Art

There has been known an electronic controlled fuel injection apparatus constituted by a fuel injection valve disposed in an intake system of an internal combustion engine (hereinafter, referred to as an "engine"), and a control apparatus which controls a valve opening time of the fuel injection valve in correspondence to an operation state of the engine so as to adjust a fuel injection quantity. In the conventional electronic controlled fuel injection apparatus, a battery stably supplying a sufficient amount of electricity is generally provided for operation of the fuel injection valve, the control apparatus and a fuel pump.

There has been also known an electronic controlled fuel injection apparatus, which is not powered with electricity from battery but is powered with electricity generated by an engine generator. The engine is rotated using a recoil starter and the electricity outputted only from the power generator driven by the engine is supplied to the fuel injection apparatus, after the engine start. For example, in an electronic controlled fuel injection apparatus disclosed in Japanese Patent No. 2,580,367, the fuel injection apparatus is configured to efficiently utilize a rotational inertia energy of a flywheel energized through manipulation of the recoil starter not to been provided any battery.

In Japanese Utility Model Publication No. H08-009393, there is proposed a fuel injection apparatus, which is provided with a storage means for storing an output of a power generator driven by the engine. Electricity supplied from the storage means compensates for the output of the power generator when the output of the power generator is lowered.

SUMMARY OF THE INVENTION

The engine provided with the fuel injection apparatus in Japanese Utility Model Publication No. H08-009393 can continue the operation to some extent with the electricity supplying from the storage means even in the case that the output of the power generator is lowered. However, there is a desire of downsizing a coil-winding portion of the power generator so as to downsize a whole of the power generator. In order to respond to the desire, it is necessary to make a storage capacity of the storage means significantly large in order to compensate for an output that is decreased caused by the downsizing of the power generator.

On the other hand, the output of the power generator is greatly reduced at a time of starting the engine. Accordingly, in the conventional apparatus, which compensates for the shortage of electricity with the electricity from the storage means, the storage means having a significantly large storage capacity is required for the compensation.

Taking the matters mentioned above into consideration makes the present invention, and the present invention direct to provide an electronic controlled fuel injection apparatus which can restrain an electricity consumption at the time of engine starting. This restraint of electricity consumption results in a downsizing both of a storage means and a power generator.

In accordance with a first aspect of the present invention, there is provided an electronic controlled fuel injection apparatus of an internal combustion engine having a fuel pump, a fuel injection valve and an ignition unit which are operated by an electricity supplied from a power generator serves as a main power source driven by the engine, comprising: a manually operated engine starter; a backup battery for the main power source; and a drive means for operating the fuel pump in the case that a revolution number of the engine is less than a predetermined first revolution number, and that the revolution number of the engine is more than a predetermined second revolution number which is higher than the first revolution number, and driving the fuel injection valve and the ignition unit at a predetermined interval such that respective drive timings do not lap over each other in the case that the revolution number of the engine is more than the first revolution number.

In accordance with a second aspect of the present invention, the fuel pump, the fuel injection valve and the ignition unit are operated by electricity obtained by rectifying a single phase output of the power generator driven by the engine, and respective main operations of the fuel pump, the fuel injection valve and the ignition unit are set to be implemented in respective different half wave waveforms of the rectified electricity. In accordance with a third aspect of the present invention, the respective main operations of the fuel pump, the fuel injection valve and the ignition unit are set to be implemented when respective amplitudes in the half wave waveforms approximately maximum.

In accordance with a fourth aspect of the present invention, the power generator is a single-phase two-pole permanent-magnet generator, and an output thereof is taken out as a full-wave rectified electricity.

In accordance with a fifth aspect of the present invention, the fuel injection valve is driven in synchronization with the half-wave waveform appearing in correspondence to a compression stroke.

Further, in accordance with a sixth aspect of the present invention, the engine is provided with a recoil starter as the engine starter for starting the engine by a manual operation.

Further, in accordance with a seventh aspect of the present invention, the backup battery is a nickel cadmium battery charged by the main power source.

In accordance with the present invention, while the revolution number of the engine is lower than the first revolution number, only the fuel pump is driven by the electricity of the backup battery, and when the engine revolution number exceeds the first revolution number, the fuel pump is stopped, and the ignition unit and the fuel injection valve are driven. Further, when the revolution number of the engine is equal to or more than the second revolution number, the sufficient electricity is supplied from the main power source, so that the fuel pump is again started.

As mentioned above, it is possible to make the backup battery compact, by restricting the electricity consumption for starting the engine when the electricity outputted from the generator is insufficient. For example, it is possible to use a dry battery or dry cell as the backup battery.

Further, in accordance with the present invention, it is possible to obtain an excellent loading performance with respect to a general engine-working machine because of a synergy of a simple starting operability of the recoil starter and a downsizing of the backup battery. The nickel cadmium battery is charged after starting the engine on the basis of its good charging performance, and it is possible to stably supply a holding power for starting to the next engine start.

Even in the case that the engine fails to be started, since the fuel pump is driven at a time when the revolution number of the engine is lowered to be equal to or less than the first revolution number, it is possible to quickly operate the starting apparatus so as to again start the engine starting operation.

In accordance with the present invention, it is possible to stably supply the electricity to each of the electronic control devices by restricting a peak value of electricity consumption such that the operations of the electric controlled devices required for the fuel injection do not coincide one other. In particular, since the structure is made such as to operate proximate to the region of the maximum amplitude so as to efficiently obtain the electricity in spite that an effective value of the output of the power generator is largely fluctuated in correspondence to the change of the revolution number of the engine, it is possible to easily secure the required electricity even in the case that the revolution number of the engine is low and the effective value of the output is small.

Further, in accordance with the present invention, since the electricity can be efficiently obtained, it is possible to use the single-phase two-pole power generator so as to secure the electricity. Accordingly, it is possible to downsize the coil-winding portion of the power generator, and a space capable of arranging the other devices or the like is generated within the power generator as well as the cost reduction. Therefore, a freedom in layout of the devices is increased.

Since the fuel injection valve is driven in synchronous with the half wave waveform, it is possible to easily set the fuel injection timing in correspondence to the output waveform of the power generator.

Further, it is possible to obtain an excellent general-purpose loading performance with respect to a general engine-working machine, owing to a simple starting operability of the recoil starter.

DETAILED DESCRIPTION OF THE PREFERRED EMBODIMENTS

Figure 2:
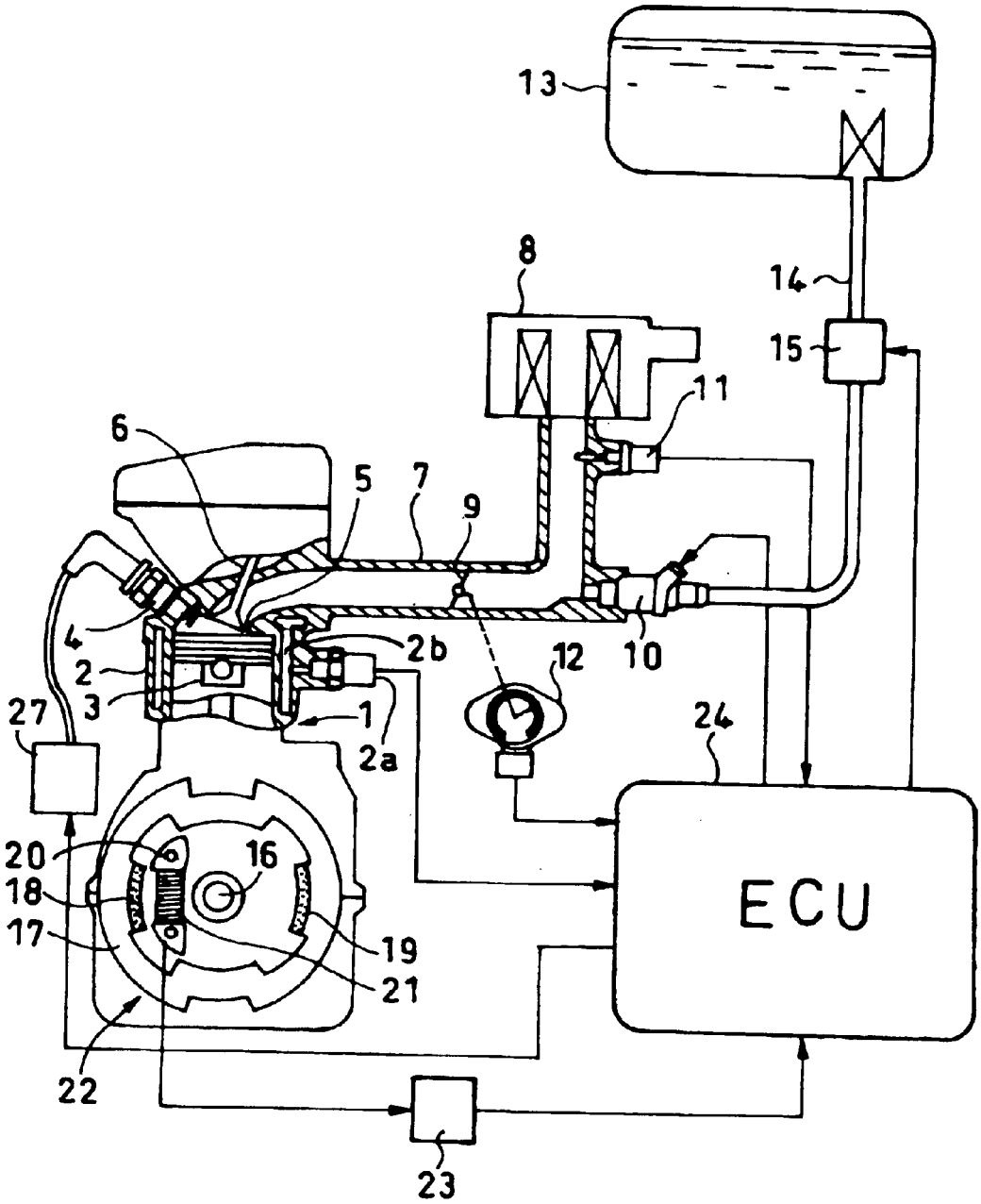
FIG. 2 is a view showing a structure of an engine in accordance with an embodiment of the present invention.

A description will be given in detail below of the present invention with reference to the accompanying drawings. FIG. 2 is a view showing a structure of an engine power generating apparatus in accordance with an embodiment of the present invention. In the drawing, a piston 3 and an ignition plug 4 are disposed in a cylinder 2 of an engine 1. An intake valve 6 is provided at an intake port 5 positioned at an upper portion of the cylinder 2, and the intake port 5 is communicated with an atmospheric air via an intake pipe 7 and an air cleaner 8. A throttle valve 9 is provided between the intake port 5 and the air cleaner 8 on the intake pipe 7, and a fuel injection valve 10 an intake temperature sensor 11 for detecting an intake temperature are disposed in an upstream side of the throttle valve 9. An opening degree of the throttle valve 9 is detected by a throttle opening degree sensor 12. A passage 2*b* through which cooling water is circulated is formed to surround the wall of the cylinder 2. A temperature of the cooling water is detected by a water temperature sensor 2*a*. The sensor 2*a* is disposed facing to the passage 2*b* at a wall of the engine 2.

A fuel tank 13 reserving a fuel to be supplied to the injection valve 10 is provided, and the fuel tank 13 and the injection valve 10 are connected by a fuel supply tube 14. A fuel pump 15 is disposed between the injection valve and the tank 13 on the fuel supply pipe 14. The fuel pump 15 regulates a pressure of the fuel to a predetermined value so as to supply the fuel to the injection valve 10. The fuel is injected into the intake pipe 7 in an upstream side of the throttle valve 9 by the injection valve 10.

A flywheel 17 having an annular portion is coupled to a crankshaft 16 of the engine 1, and magnets 18 and 19 are mounted to an inner periphery of the annular portion of the flywheel 17. A stator core 20 is provided in an opposing position to the magnets 18 and 19, and a coil winding 21 is wound around the stator core 20. A single-phase two-pole power generator (a main power source) 22 is comprised of the magnets 18 and 19, the stator core 20 and the coil winding 21. The crankshaft 16 is provided with a connection part (not shown) for engaging a recoil stator. The recoil starter and a mounting structure thereof are described, for example, in Japanese Unexamined Patent Publication Nos. 2001-207941 and 2000-328957, and these well-known recoil starters can be incorporated into the engine in accordance with the present embodiment.

The coil winding 21 is connected to a power source circuit 23 rectifying and stabilizing a generated voltage, and a power voltage is applied to an electronic control unit (hereinafter, refer to as an ECU) 24 from the power source circuit 23. Detection signals of the sensors 11, 12 and 2*a* are supplied to the ECU 24.

The ECU 24 supplies signals to the fuel pump 15, an ignition unit 27 and the injection valve 10 for driving the respective devices. The electricity is supplied to the fuel pump 15, the ignition unit 27 and the injection valve 10 via the power source circuit 23 through a power cable (not shown).

Figure 3:
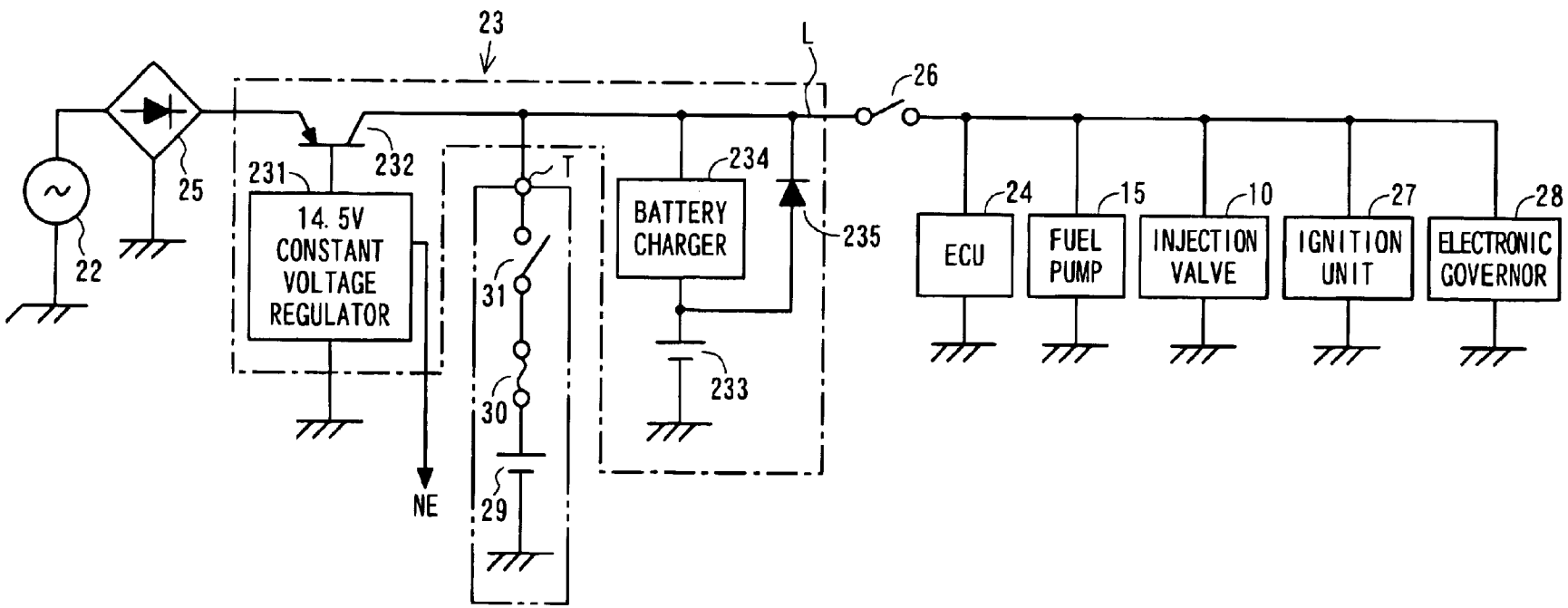
FIG. 3 is a view of a main electric system of the engine including a power source circuit.

FIG. 3 is a view of an electric system including the power source circuit 23. In the drawing, an output of the power generator 22 is connected to the power source circuit 23 via a full-wave rectifier 25. The power source circuit 23 is provided with a constant voltage regulator 231 adjusting an output voltage that is applied via the full-wave rectifier 25 to a constant voltage (for example, 14.5 volt), a transistor 232, a backup battery 233 and a battery charger 234 thereof. The battery 233 properly employs a rechargeable battery, for example, a nickel cadmium battery having a rated voltage of 6 volt. A back-flow preventing diode 235 is provided between the battery 233 and a power source line L.

The constant voltage regulator 231 controls the transistor 232 such that the output of the full-wave rectifier 25 is equal to or lass than a predetermined voltage. The battery charger 234 is controlled by the ECU 24 so as to charge the battery 234 with the output of the power generator 22 adjusted to the constant voltage when the charged voltage of the battery 233 is less than a predetermined value (the value is lower than 6 volt). The ECU 24, the fuel pump 15, the injection valve 10, the ignition unit 27 and an electronic governor 28 for controlling the revolution number of the engine are connected to the output side of the power source circuit 23 via a power source switch 26. An output waveform of the power generator 22 is detected, for example, at the constant voltage regulator 231, and is input to the ECU 24 for calculating a revolution number of the power generator 22, that is, a revolution number NE of the engine 1. The ECU 24 calculates the revolution number NE of the engine 1 on the basis of a frequency of the output waveform. Further, the ECU 24 detects a position where amplitude of the waveform is zero, that is, a rising point of a half-wave waveform of the full-wave rectified power generator output, on the basis of the input output waveform. The rising of the half-wave waveform is used at a time of determining an operation timing of the electronic control device mentioned above.

The power source circuit 23 may be provided with an external terminal T for connecting an external storage battery, for example, a storage battery 29 having a rated voltage of 12 volts. This is because the storage battery 29 can be connected as an auxiliary at a time when the battery 233 is discharged. The storage battery 29 is connected to the external terminal T via a fuse 30 and a switch 31.

Figure 4:
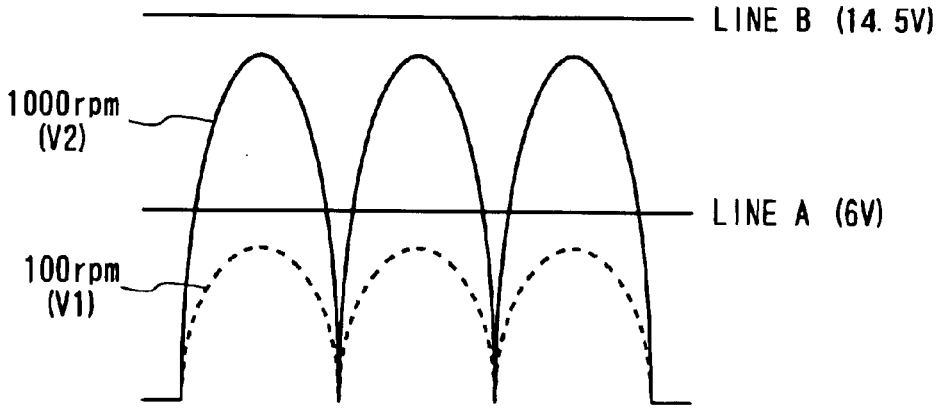
FIG. 4 is a view showing an example of an output waveform of a power generator corresponding to a main power source.

FIG. 4 is a view showing an example of an output waveform of the power generator 22. In the drawing, the voltage (6 volt) of the battery 233 constituted by the nickel cadmium battery is shown by a line A, and a maximum output voltage (14.5 volt) of the regulator 231 is shown by a line B. When the revolution number NE of the engine 1 is 100 rpm (the first revolution number), an output voltage V1 of the power generator 22 after being rectified by the full-wave rectifier is lower than the voltage line A of the battery 233. Further, in the case that the revolution number NE of the engine 1 is 1000 rpm (the second revolution number), an output voltage V2 of the power generator after being rectified is more than the voltage line A of the battery 233, and comes approximately close to the maximum output voltage line B of the ragulator 231.

Figure 1:
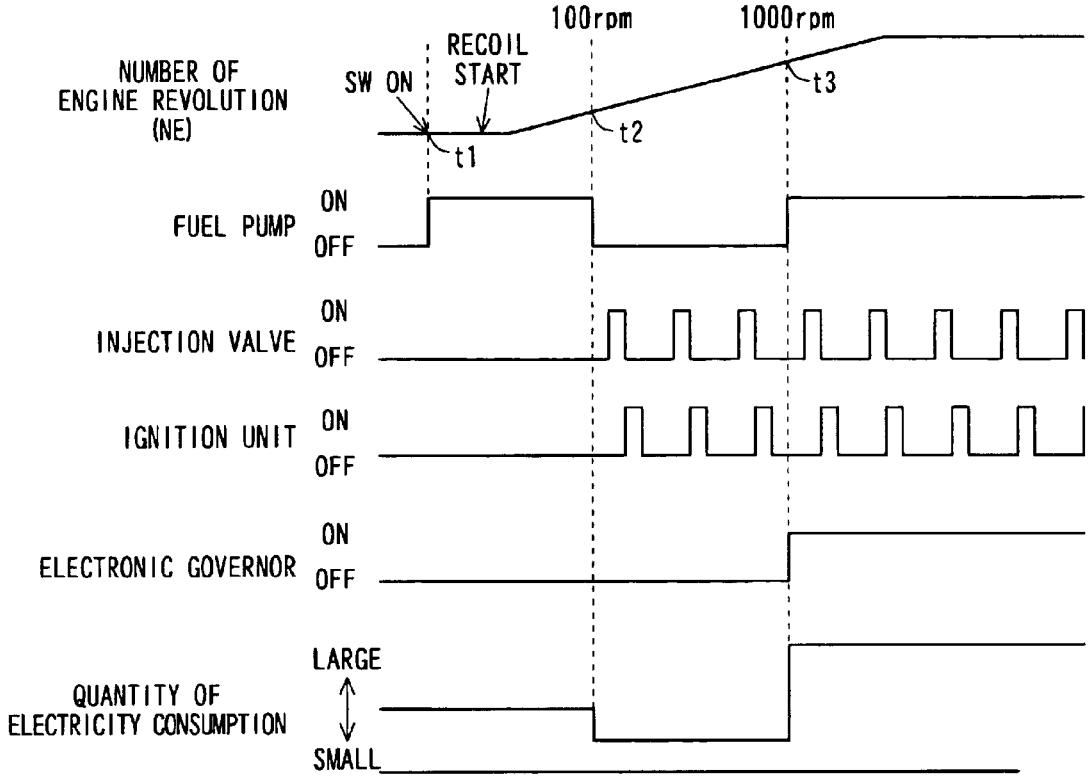
FIG. 1 is a timing chart showing an operation timing of electric controlled devices corresponding to an engine revolution number.

In the present embodiment, the operation timing of each of the electronic control devices at a time of starting the engine is controlled as follows while taking into consideration the output of the power generator 22 at a time of rotating the engine at a low speed. FIG. 1 is a timing chart showing the operation timing of the fuel pump 15, the injection valve 10, the ignition unit 27 and the electronic governor 28 corresponding to the electronic control devices in connection with the engine revolution number NE. In the drawing, when turning on the power source switch 26 at a time point t1, the fuel pump 15 is driven (turned on). Since the engine 1 is not rotated at this time point t1, the electric voltage of the battery 233 is higher than an electric potential of the power source line L (FIG. 3). Accordingly, the electricity is supplied to the fuel pump 15 from the battery 233 through a diode 235.

As the fuel pump 15 is started to drive, a fuel pressure rises, and when the pressure becomes high enough to open the injection valve, the fuel can be injected. Accordingly, driving the fuel pump 15 and thereafter the engine 1 is rotated using the recoil starter. After the engine 1 starts rotating by the recoil starter, the fuel pump 15 is stopped (turned off) at a time point t2 when the revolution number NE of the engine 1 comes up to the first revolution number, for example, 100 rpm. Further, the engine 1 is ignited by driving the injection valve 10 and by energizing the ignition unit 27. In the injection valve 10 and the ignition unit 27, the timing and the operating time are set such that both the devices are prevented from being coincidently driven. Coincidental operation of the both devices causes a large amount of electricity consumption, whereby the supply powers by the battery 233 and the power generator 22 comes short.

When the revolution number NE of the engine comes up to the second revolution number, for example, 1000 rpm, it is determined that the engine 1 is securely started, and the output voltage of the power generator 22 may be increased. Accordingly, the engine 1 can be entered into the rated operation after a timing t3 with the fuel pump 15, the injection valve 10, the ignition unit 27 and the electronic governor 28 are all operated. Further, it is possible to preferably supply the electricity from the power source circuit 23 in correspondence to the electricity consumption at a time of starting the engine which is changed corresponding to the operation state of each of the parts as shown in the lowermost stage in FIG. 1.

When the engine revolution number is lowered after temporarily exceeding the first revolution number, that is, in the case of failing to start, the operations of the injection valve 10 and the ignition unit 27 are stopped, and only the fuel pump 15 is left energized. Accordingly, even in the case of failing to start, the starting operation of the engine 1 can be again started by immediately operating the recoil starter.

Figure 5:
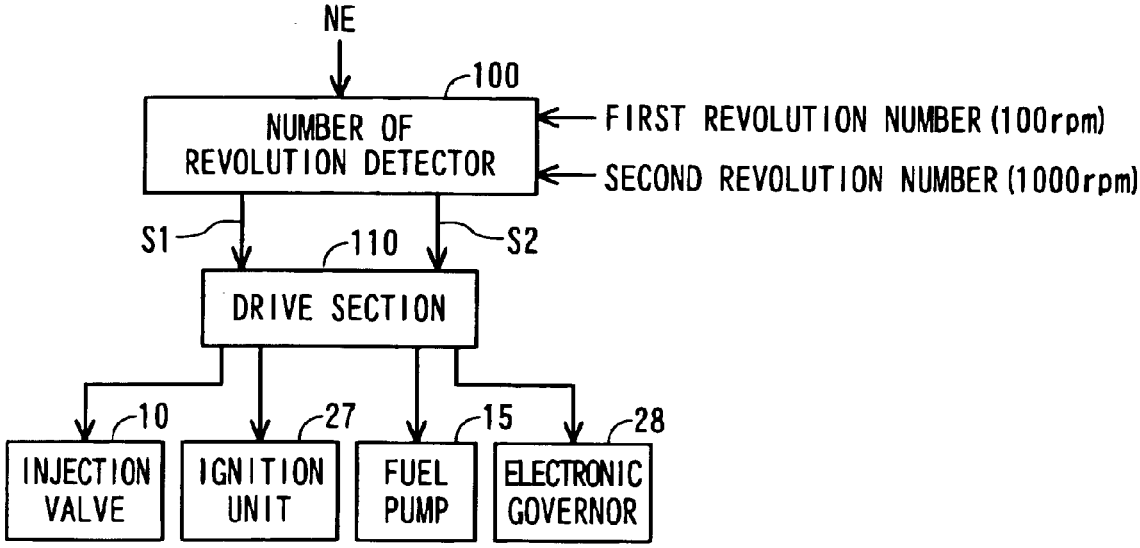
FIG. 5 is a block diagram showing a main function of an ECU in accordance with an engine start.

FIG. 5 is a block diagram showing a main function of the ECU 24 in accordance with the engine start. In order to start the engine, the ECU 24 is provided with a revolution number detector 100 and a drive section 110. Both the revolution number detector 100 and the drive section 110 are operated if the power source switch 26 is turned on and the electricity supply from the power source circuit 23 is started. The revolution number detector 100 outputs a detection signal s1 in the case that the revolution number NE of the engine 1 exceeds the first revolution number, and inputs a detection signal s2 to the drive section 110 in the case that the revolution number NE of the engine 1 exceeds the second revolution number which is higher than the first revolution number. The drive section 110 carries out a predetermined operation responsive to the signals s1 and s2 from the revolution number detector 100. In the case that the signal s1 is not detected, that is, in the case that it is determined that the revolution number NE of the engine is lower than the first revolution number, the drive section 110 drives the fuel pump 15. On the other hand, in the case that the signal s1 is detected, that is, in the case that it is determined that the revolution number NE of the engine exceeds the first revolution number, the drive section 110 operates to stop the fuel pump 15, while operating to drive the injection valve 10 and the ignition unit 27. In this case, the injection valve 10 and the ignition unit 27 are alternately driven, that is, both the devices 10 and 27 are not driven coincidently.

If the detection signal s2 is detected, the drive section 110 determines that the engine 1 securely rotates by its own ability, and outputs command to drive the fuel pump 15, the injection valve 10, the ignition unit 27 and the electronic governor 28. If the engine 1 fails to be started, the revolution number NE of the engine becomes equal to or less than the first revolution number and the detection signal s1 disappears. Accordingly, only the fuel pump 15 is again driven.

A description will be given in more detail of the operation timings of the fuel pump 15, the injection valve 10 and the ignition unit 27 in connection with the output voltage of the power source circuit 23.

Figure 6:
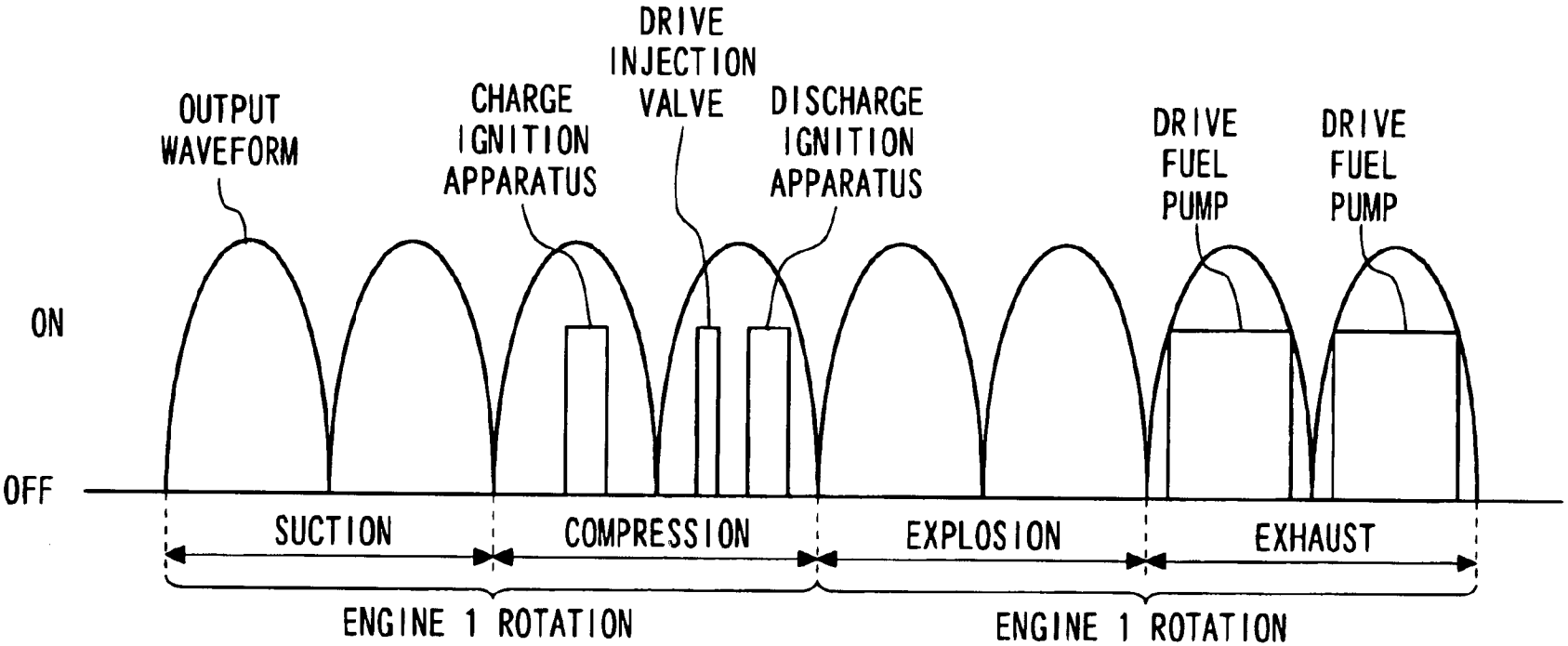
FIG. 6 is a view showing a relation between an output waveform of a full-wave rectifier and the operation timing of the electronic control devices.

FIG. 6 is a view showing a relation between the output waveform the full-waver rectifier 25, and the operation timings of the fuel pump 15, the injection valve 10 and the ignition unit 27. The operation timings with respect to the output waveform are the same in both of the engine starting time and the normal operating time after a complete ignition of the engine.

In the present embodiment, since the power generator 22 is a single-phase two-pole power generator, the output of the full-wave rectifier 25 forms four half-wave waveforms per one revolution of the engine 1. The engine 1 is a 4-cycle engine executing one cycle operation per two revolutions. The charging and the discharging of the ignition unit 27 and the driving of the injection valve 10 are executed in synchronous with respect to the latter half of two half-wave waveforms within four half-waveform waveforms formed at a time of the first revolution, that is, the intake and compression time. The charging of the ignition unit 27, and the discharging of the ignition unit 27 and the driving of the injection valve 10 are illustratively distributed in two half-wave waveforms and synchronized respectively. In the charging and the discharging of the ignition unit 27, the electricity consumption is larger in the charging than in the discharging, and the electricity consumption for the discharging operation is small. Because in discharging, the electricity supplied only for creating the trigger signal. As mentioned above, in the case that a plurality of operations are executed by the single electronic control device, the operations are executed such that the operation (the main operation) having the largest electricity consumption does not coincides with the main operation of the other electronic control devices, and are not allocated within the same half-wave waveform. For example, the charging of the ignition unit 27 and the driving of the injection valve 10 are operated in synchronization with the different half-wave waveforms from each other. Further, the fuel pump 15 is driven in synchronous with respect to the latter half of two half-wave waveforms within four half-wave waveforms formed at the second revolution time, that is, the ignition stroke and the exhaust stroke, respectively. The operation voltage of the electronic controlled device such as the injection valve 10 or the like is set so as to comply with the voltage of the battery 233, for example, comply with the voltage 6 volt of the nickel cadmium battery.

Since the charging and the discharging of the ignition unit 27, and the driving of the injection valve 10 are short in their time compared with the duration of the half-wave waveform, they may be started at a timing when the voltage value of the voltage line L is more than 6 volts so as to comply with the ignition timing of the engine 1. For example, in the case that the voltage does not come up to 6 volts at a separately set fuel injection timing, the injection valve 10 is driven at a time when the voltage of the voltage line L come up to 6 volts. Further, in the case that the voltage of the voltage line L comes up to 6 volts at the fuel injection timing, the injection valve 10 is immediately driven. Since the cycle of the half-wave waveform is short (about 4 second at 3600 rpm), the operation of the engine 1 is not affected even if the fuel injection timing is shifted in some degree from an optimum timing by being coincided with the half-wave waveform.

On the other hand, the fuel pump 15 is set such as to be turned on in the case that the voltage value exceeds a threshold value, for example, 6 volts after detecting the rising phase of the half-wave waveform. Accordingly, it is possible to efficiently supply the electricity to the fuel pump 15 within the half-wave waveform.

The synchronization of the operations of the electronic controlled devices mentioned above, such as the injection valve 10 and the like with respect to the half-wave waveform is not limited to the example mentioned above, and may be structured as far as the electricity can be efficiently taken out within the half-wave waveform. In other words, the operation start timing within each of the half-wave waveform may be set such that a predetermined operation voltage (for example, 6 volts) can be maintained for a predetermined operation time.

Preferably, the operation timing of each of the electronic controlled devices is set to a position proximate to the maximum amplitude region within the half-wave waveform. Accordingly, even in the case that the revolution number of the engine is low and the effective value of the electricity is low, it is easy to secure the predetermined operation voltage.

In the present embodiment, the recoil starter is used as the manually operated type engine start apparatus, however, the present invention is not limited to this, but can appropriately use a power storage type starter, a kick type starter and the like.

Further, the present invention is not limited to the injection unit of the engine to be started manually. It goes without saying that an efficient use of the electricity can be intended even in the case that the present invention is applied to a power generating apparatus started by a electric starter motor.

Since the backup battery provided in parallel to the main power source can be downsized, and it is possible to rapidly carry out a preparation for the restarting operation even if the engine fails to be started, it is possible to improve a start operability of the engine.

Since it is possible to avoid the matter that the peak of the electricity consumed for the fuel injection becomes higher, and it is possible to effectively secure the sufficient electricity, it is possible to intend to downsize the power generator driven by the engine to which the fuel injection control apparatus in accordance with the present invention is applied.

What is claimed is:

1. An electronic controlled fuel injection apparatus of an internal combustion engine having a fuel pump, a fuel injection valve and an ignition unit which are operated by electricity supplied from a power generator which serves as a main power source driven by the engine, comprising:

a manually operated engine starter;

a battery provided in parallel to the main power source which serves as a backup of the main power source; and a detector for detecting a revolution number of the engine;

a drive means for operating the fuel pump in the case that a revolution number of the engine is less than a predetermined first revolution number, and that the revolution number of the engine is more than a predetermined second revolution number which is higher than the first revolution number, and driving the fuel injection valve and the ignition unit at a predetermined interval in the case that the revolution number of the engine is more than the first revolution number such that operations of the fuel injection valve and the ignition unit do not coincide with each other.

2. An electronic controlled fuel injection apparatus of an internal combustion engine of claim 1, further comprising a rectifier connected with the generator for rectifying a single phase output of the generator to create the electricity to be supplied to the fuel pump, the fuel injection valve and the ignition unit, and wherein respective main operations of the fuel pump, the fuel injection valve and the ignition unit are set to be implemented at times corresponding to respective different half wave waveforms from each other in half wave waveforms of said rectified electricity.

3. An electronic controlled fuel injection apparatus of an internal combustion engine of claim 2, wherein the respective main operations of said fuel pump, the fuel injection valve and the ignition unit are set to be implemented when respective amplitudes in the half wave waveforms approximately maximum.

4. An electronic controlled fuel injection apparatus of an internal combustion engine of claim 2, wherein the power generator is a single-phase two-pole permanent-magnet generator, and the rectifier is a full-wave rectifier.

5. An electronic controlled fuel injection apparatus of an internal combustion engine of claim 4, wherein the fuel injection valve is driven in synchronization with said half-wave waveform appearing in correspondence to a compression stroke.

6. An electronic controlled fuel injection apparatus of an internal combustion engine of claim 1 or 2, wherein the engine starter is a recoil starter for starting the engine by a manual operation.

7. An electronic controlled fuel injection apparatus of an internal combustion engine of claim 1, wherein the battery is a nickel cadmium battery charged by the main power source.

* * * * *